US009494010B2

(12) United States Patent
Flores

(10) Patent No.: US 9,494,010 B2
(45) Date of Patent: Nov. 15, 2016

(54) SYNCHRONIC DUAL PACKER

(71) Applicant: BAKER HUGHES INCORPORATED, Houston, TX (US)

(72) Inventor: Juan Carlos Flores, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 134 days.

(21) Appl. No.: 14/318,952

(22) Filed: Jun. 30, 2014

(65) Prior Publication Data

US 2015/0376968 A1 Dec. 31, 2015

(51) Int. Cl.
*E21B 33/124* (2006.01)

(52) U.S. Cl.
CPC ..... *E21B 33/124* (2013.01)

(58) Field of Classification Search
CPC combination set(s) only.
See application file for complete search history.

(56) References Cited

U.S. PATENT DOCUMENTS 2,967,994 A * 1/1961 Peterson ..... E21B 47/0905 324/221
3,324,952 A * 6/1967 Berryman ..... E21B 23/006 166/140
4,962,815 A 10/1990 Schultz et al.
5,832,998 A * 11/1998 Decker ..... E21B 33/127 166/185
6,257,338 B1 7/2001 Kilgore
6,533,037 B2 3/2003 Eslinger et al.
6,655,461 B2 12/2003 Eslinger et al.
6,695,057 B2 2/2004 Ingram et al.
6,883,610 B2 4/2005 Depiak
6,926,088 B2 8/2005 Tinker
7,051,812 B2 5/2006 Mckee et al.
7,059,407 B2 6/2006 Tolman et al.
7,090,020 B2 8/2006 Hill et al.
7,243,727 B2 7/2007 Tudor et al.
7,472,746 B2 1/2009 Maier
7,571,765 B2 8/2009 Themig
7,647,980 B2 1/2010 Corre et al.
7,681,654 B1 3/2010 Cugnet
7,832,472 B2 11/2010 Themig (Continued)

FOREIGN PATENT DOCUMENTS

CA 2623100 3/2007

OTHER PUBLICATIONS

Korean Intellectual Property Office; International Searching Authority; International Search Report and Written Opinion for Application No. PCT/US2015/034808 dated Aug. 27, 2015.

(Continued)

*Primary Examiner* — William P Neuder
*Assistant Examiner* — Ronald Runyan
(74) *Attorney, Agent, or Firm* — Parsons Behle & Latimer

(57) ABSTRACT

A downhole tool having a first packing element and a second packing element configured to synchronically set to selectively hydraulically isolate a portion of the wellbore. The movement of a pin along a j-slot track on a second sleeve sets the second packer in compression and the movement of a pin along a j-slot track on a first sleeve the first packer in tension after the second packer has been set. The j-slot track on the first sleeve has six different pin positions and the j-slot track on the second sleeve has four different pin positions. The pin positions and direction of travel of the j-slot tracks are adapted to permit the synchronized setting of the two packing elements to hydraulically isolate a portion of the wellbore. The wellbore may then be treated by flowing fluid out of a ported sub positioned between the packing elements.

29 Claims, 11 Drawing Sheets

(56) References Cited

U.S. PATENT DOCUMENTS

| | | | |
|---|---|---|---|
| 7,866,387 | B2 | 1/2011 | Van Zuilekom et al. |
| 7,913,557 | B2 | 3/2011 | Vasques et al. |
| 8,016,032 | B2 | 9/2011 | Mandrell et al. |
| 8,418,755 | B2 | 4/2013 | Howard et al. |
| 8,434,550 | B2 | 5/2013 | Howard et al. |
| 8,631,872 | B2 | 1/2014 | East, Jr. |
| 8,672,036 | B2 | 3/2014 | Hughes et al. |
| 8,950,505 | B2 | 2/2015 | Themig et al. |
| 9,051,813 | B2 | 6/2015 | Howard et al. |
| 9,062,544 | B2 | 6/2015 | Landsiedel |
| 9,181,773 | B2 | 11/2015 | Watson et al. |
| 9,316,083 | B2 | 4/2016 | Vasques et al. |
| 9,347,299 | B2 | 5/2016 | Gisolf et al. |
| 9,359,854 | B2 | 6/2016 | Hughes et al. |
| 2004/0238173 | A1* | 12/2004 | Bissonnette ..... E21B 34/14 166/307 |
| 2008/0053652 | A1 | 3/2008 | Corre et al. |
| 2011/0067870 | A1 | 3/2011 | East, Jr. |
| 2011/0315389 | A1 | 12/2011 | Crider et al. |
| 2013/0192897 | A1* | 8/2013 | MacKenzie ..... E21B 7/00 175/57 |
| 2015/0129197 | A1 | 5/2015 | Andreychuk et al. |
| 2015/0204162 | A1 | 7/2015 | Gay et al. |
| 2016/0115770 | A1 | 4/2016 | Kent |

OTHER PUBLICATIONS

U.S. Patent and Trademark Office; Office Action issued in U.S. Appl. No. 14/718,693 dated Mar. 28, 2016.

* cited by examiner

SYNCHRONIC DUAL PACKER

BACKGROUND

Field of the Disclosure

The embodiments described herein relate to downhole tool comprising synchronized packers to hydraulically isolate a portion of a wellbore.

Description of the Related Art

Hydraulically set straddle packers have been previously used to hydraulically isolate a portion of a wellbore. The packing elements of the straddle packer are set upon the application of a predetermined hydraulic pressure to expand the seals into sealing engagement with the casing or tubing of the wellbore. The hydraulic expansion of the sealing elements deteriorates the seals permitting the setting of such a straddle packers for a small finite amount times within a wellbore before the sealing elements need to be replaced.

A downhole tool may include cup seals that expand out to seal against the casing or tubing in an attempt to seal of the tool with the casing or tubing. However, cups often don't seal equally against the tubing or casing and thus, don't have the sealing integrity desired during completion of an operation with the downhole tool. Mechanical actuating seals generally last longer than the sealing of a hydraulically set straddle packer. A downhole tool may require two sealing elements in order to hydraulically isolate a portion of a wellbore from both above and below the tool. The use of two mechanically set sealing elements may be problematic on a downhole tool. For example, the movement of the tool to set one of the packing elements may unset the other packing element on the tool. It may be desirable for a downhole that permits the mechanical setting of a first packing element and the later mechanical setting of a second packing element that does not unset the first packing element.

SUMMARY

The present disclosure is directed to a downhole tool having synchronized packers and method that overcomes some of the problems and disadvantages discussed above.

One embodiment is a dual packer comprising a first packing element and a second packing element. The dual packer includes a first sleeve having a first j-slot track, wherein movement of a first pin along the first j-slot track actuates the first packing element between a set position and a running position. The dual packer includes a second sleeve having a second j-slot track, wherein movement of a second pin along the second j-slot track actuates the second packing element between a set position and a running position. The first packing element may be an upper packer that is set in tension and the second packing element may be a lower packer that is set in compression. The first packing element may be an upper packer that is set in compression and the second packing element may be a lower packer that is set in tension. The dual packer may be used for treating a wellbore formation. The treating of the wellbore formation may further comprise stimulating the wellbore formation. The treating of the wellbore formation may further comprise fracturing the wellbore formation.

The second j-slot track of the dual packer may be inverted with respect to the first j-slot track. The first j-slot track may have six pin positions along a circumferential length of the first j-slot track and the second j-slot track may have four pin positions along a circumferential length of the second j-slot track. The six pin positions of the first j-slot track may be approximately sixty degrees apart and the four pin positions of the second j-slot track may be approximately ninety degrees apart. The movement of the second pin from a second pin position to a third pin position along the second j-slot track may set the second packing element and movement of the first pin from a third pin position to a fourth pin position along the first j-slot track may set the first packing element. A second distance between the third pin position and a fourth pin position of the second j-slot track may be greater than a first distance between the third pin position and the fourth pin position of the first j-slot track. The first distance may be approximately two thirds the second distance. The first j-slot track may include more than one set of six pin positions along a circumferential length of the first j-slot track and the second j-slot track may include more than one set of four pin positions along a circumferential length of the second j-slot track.

One embodiment is a system to isolate a treat a portion of a wellbore. The system comprising an upper packer, a lower packer, and a portion sub being connected between the upper packer and the lower packer. The system includes a first sleeve having a j-slot track, wherein movement of a first pin along the j-slot track of the first sleeve actuates the upper packer between a set position and a running position. The system includes a second sleeve having a j-slot track, wherein movement of a second pin along the j-slot track of the second sleeve actuates the lower packer between a set position and a running position. The system may include a work string connected to the upper packer, wherein fluid may be pumped down the work string and out the ported sub. The j-slot track of the second sleeve of the system may be inverted with respect to the j-slot track of the first sleeve. The j-slot track of the first sleeve may have six pin positions along the first sleeve and the j-slot track of the second sleeve may have four pin positions along the second sleeve.

One embodiment is a method of isolating a portion of a wellbore. The method comprises running a tool on a work string into a wellbore and positioning the tool adjacent a portion of the wellbore. The method comprises picking up the work string, setting a lower packer of the tool, and setting an upper packer of the tool after setting the lower packer. The method comprises releasing the upper packer of the tool and releasing the lower packer of the tool after releasing the upper packer.

Picking up the work string may move a first pin from a first pin position on a j-slot track of a first sleeve to a second pin position and may move a second pin from a second pin position on a j-slot track of a second sleeve to a second pin position. Setting the lower packer may comprises moving the first pin from the second pin position on the j-slot track of the first sleeve to a third position and moving the second pin from the second pin position on the j-slot track of the second sleeve to a third position. Setting the upper packer may comprises moving the first pin from the third pin position on the j-slot track of the first sleeve to a fourth pin position while the lower packer remains set. Releasing the upper packer may comprise moving the first pin from the fourth pin position on the j-slot track of the first sleeve to a fifth pin position while the lower packer remains set. Releasing the lower packer may comprise moving the first pin from the fifth pin position on the j-slot track of the first sleeve to a sixth pin position and moving the second pin from the third pin position on the j-slot track of the second sleeve to a fourth pin position. The method may include pumping fluid down the work string and out a ported sub of the tool after setting the upper packer of the tool. The upper packer may be set in tension and the lower packer may be set in compression.

Figures 1A, 1B, 1C, 1D:
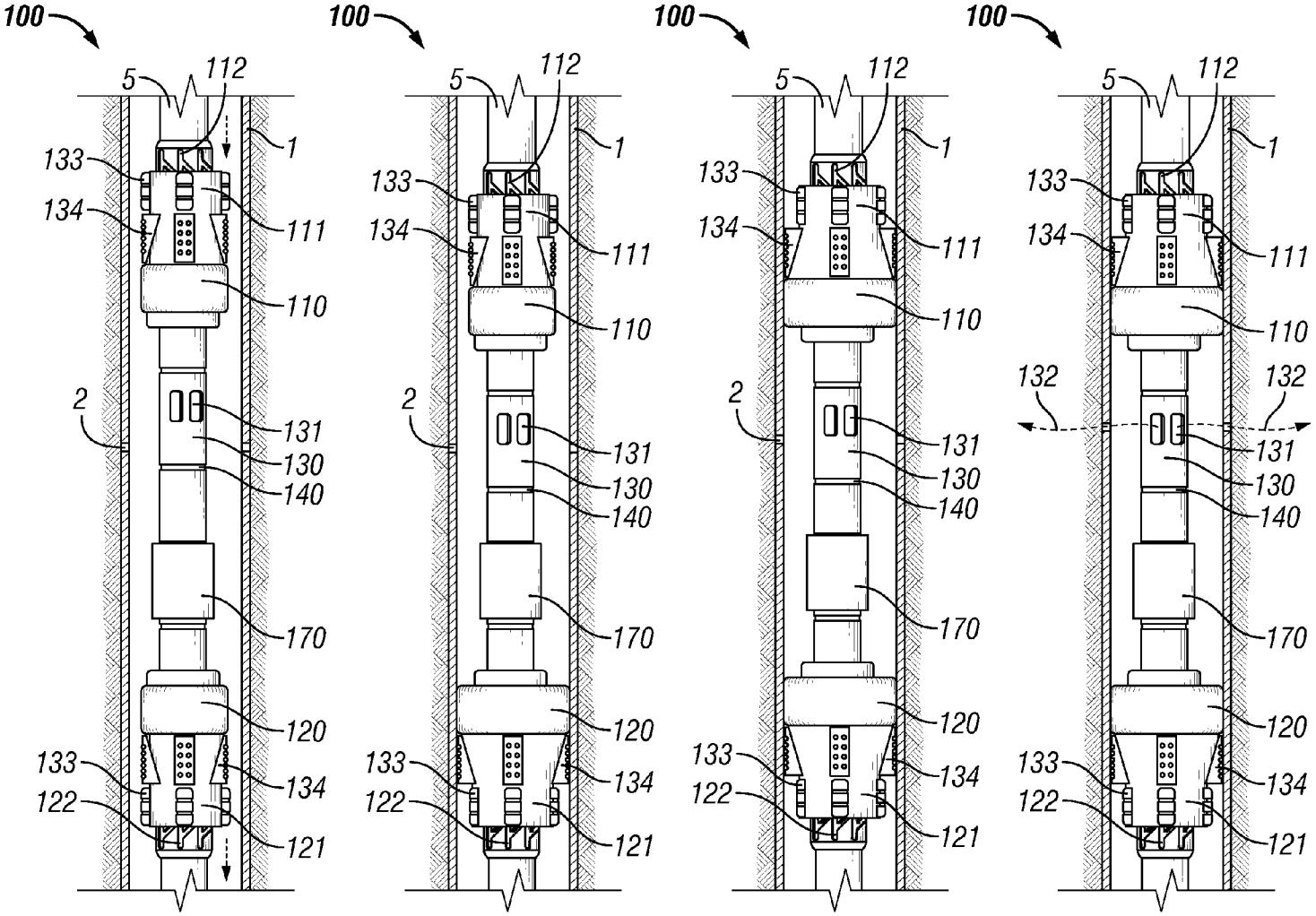
FIG. 1A shows an embodiment of a downhole tool having two packing elements within a wellbore.
FIG. 1B shows an embodiment of a downhole tool with the lower packing element set within a wellbore.
FIG. 1C shows an embodiment of a downhole tool with the upper and lower packing elements set within a wellbore.
FIG. 1D shows the treatment of a portion of a wellbore that has been hydraulically isolated by an embodiment of a downhole tool.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1A shows an embodiment of a downhole tool 100 having a first packing element 110 and a second packing element 120. The first packing element 110 may be an upper packer and the second packing element 120 may be a lower packer. The first and second packing elements 110 and 120 may each comprise a plurality of packing elements configured to create a seal between the tool 100 and casing 1, or tubing, of a wellbore. The downhole tool 100 is conveyed into the wellbore via a work string 5 and positioned at a desired location within the wellbore. For example, the downhole tool 100 may be positioned adjacent a perforation (s) 2 in the casing 1. The wellbore may then be treated via the tool 100 as discussed herein. The work string 5 may be various strings as would be appreciated by one of ordinary skill in the art having the benefit of this disclosure. FIG. 1A shows the packing elements 110 and 120 in a running position, i.e. a retracted or unset orientation, so that the tool 100 may be moved through the casing or tubing 1 of the wellbore. The tool 100 includes a ported sub 130 having one or more flow ports 131 and a quick disconnect sub 140 that are described herein.

FIG. 1B shows the second, or lower, packing element 120 set against the casing 1 of the wellbore to create a seal between the tool 100 and the casing 1. The second packing element 120 may be set in compression by the rotation of a sleeve or rotating sub 121 connected to the second packing element 120 as described herein. The rotation of the sleeve or rotating sub 121 moves an element along a j-slot track 122 that actuates the second packing element between a set and unset state as described herein. FIG. 1C shows the first, or upper, packing element 110 set against the casing 1 of the wellbore to create a seal between the tool 100 and the casing 1. The first packing element 110 may be set in tension by the rotation of a sleeve or rotating sub 111 connected to the first packing element 110 as described herein. The rotation of the sleeve or rotating sub 111 moves an element along a j-slot track 112 that actuates the first packing element between a set and unset state as described herein. The downhole tool 100 may include a slip joint 170 positioned between the upper and lower packing elements 110 and 120. The slip joint 170 permits the lengthening of the distance between the lower packing element 120 and the upper packing element 110 while the upper packing element 110 is being set within the wellbore. As detailed herein, the lower packing element 120 may be set within the wellbore before the upper packing element 110 is set. The lengthening of the distance between the packing elements 110 and 120 may aid in preventing the lower packing element 120 from becoming unset during the setting of the upper packing element 110.

The setting of the first and second packing elements 110 and 120 hydraulically isolates the portion of the wellbore between the packing elements 110 and 120 from the rest of the wellbore. The downhole tool 100 may include drag blocks 133 and slips 134 to help retain the packing elements 110 and 120 in a set state within the casing 1. FIG. 1D shows the treatment of the wellbore by flowing fluid out of the flow ports 131 of the ported sub 130 as shown by arrows 132. The formation of the wellbore may be treated via perforations 2 through the casing 1. Fluid is pumped down the work string 5 and out the ports 131 of the ported sub 130. After the portion of the wellbore has been treated, the packing elements 110 and 120 may be unset, i.e. moved to their running position, and the tool 100 may be moved to another location within the wellbore. Treating the wellbore formation may comprise various applications such as stimulating or fracturing the formation as would be appreciated by one of ordinary skill in the art having the benefit of this disclosure. The quick disconnect sub 140 permits the upper portion of the tool 100 to be disconnected from the second packing element 120 to the extent the tool 100 becomes stuck within the wellbore. The upper portion of the tool 100 and the work string 5 may then be removed from the wellbore. The lower portion of the tool 100 may then be fished out of the wellbore. Alternatively, the lower portion of the tool 100 may be drilled out or simply pushed to the bottom of the wellbore.

Figure 2:
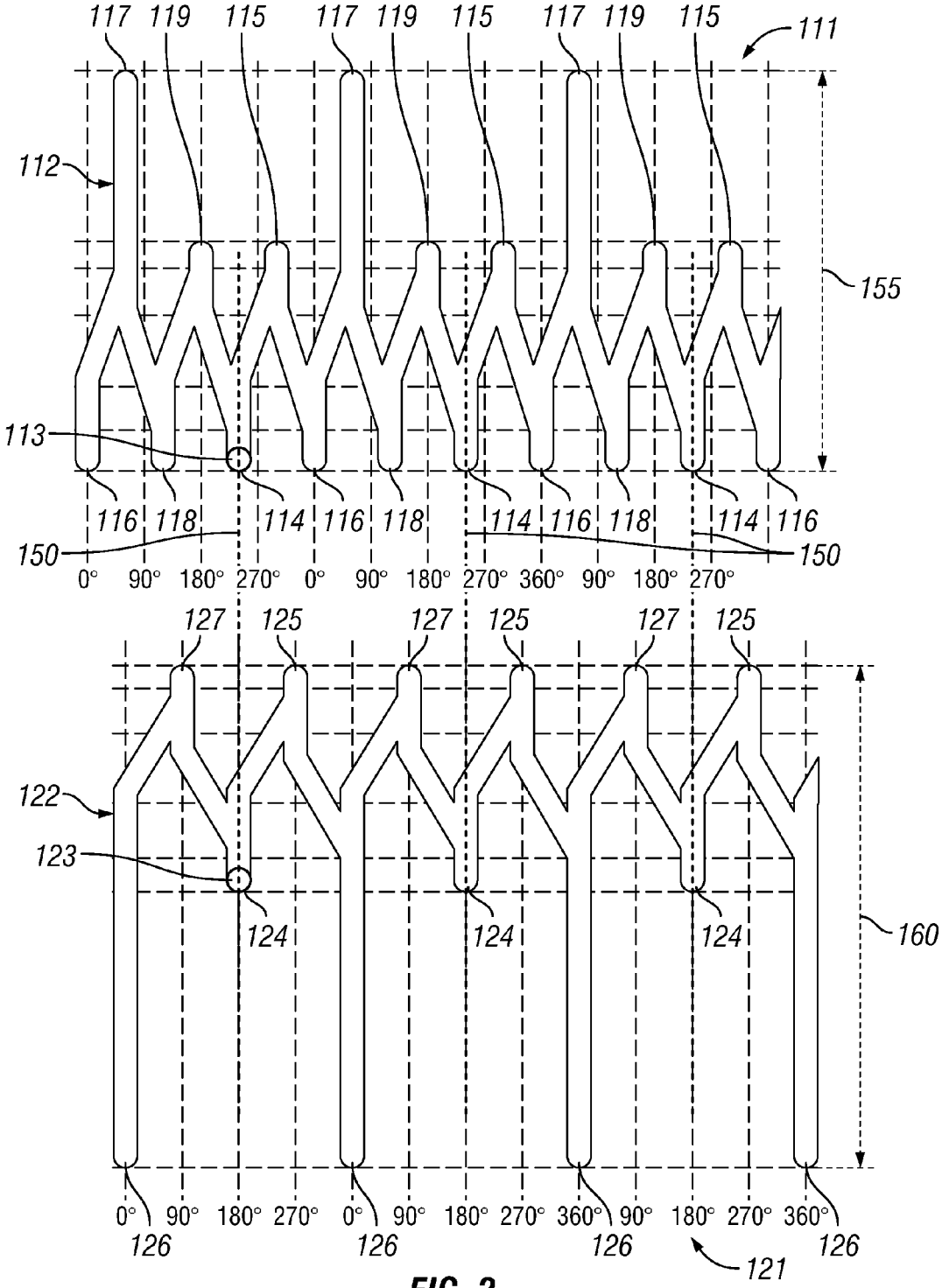
FIG. 2 shows a depiction of an upper sleeve having a continuous j-slot track and a depiction of a lower sleeve having a continuous j-slot track.

FIG. 2 schematically depicts an embodiment of a first, or upper, sleeve 111 having a first continuous j-slot track 112 and schematically depicts an embodiment of a second, or lower, sleeve 121 having a second continuous j-slot track 122. The sleeves 111 and 121 are circular and have the continuous j-slot tracks 112 and 122 extending completely around the perimeter of the sleeves 111 and 121. The sleeves 111 and 121 have been shown schematically, i.e. have been shown flattened out with more 360 degrees shown, for illustrative purposes only. FIG. 2 shows a first, or upper, pin 113 at a first pin position 114 on the first j-slot track 112 and a second, or lower, pin 123 at a first pin position 124 on the second j-slot track 122. The first and second packing elements 110 and 120 are in the running, or unset, positions (shown in FIG. 1A) when the pins 113 and 123 are in their respective first pin positions 114 and 124. The downhole tool 100 is run into the wellbore with the pins 113 and 123 in their respective first pin positions 114 and 124.

As shown in FIG. 2, the first pin positions 114 and 124 of the first and second j-slot tracks 112 and 122 are in axial alignment with each other as indicated by line 150. Thus, the two packing elements 110 and 120 are synchronized being placed into the running positions together as detailed herein. The second j-slot track 122 is inverted with respect to the first j-slot track 112, in that the direction of travel of the second pin 123 along the second j-slot track 122 to the set position, the third pin position 126, for the second packing element 120 is in the opposite direction of travel that the first pin 113 travels along the first j-slot track 112 to the set position, the fourth pin position 117, for the first packing element 110 as described herein. In the embodiment shown, the second pin 123 travels in a downward direction to reach the set position and the first pin 113 travels in an upward direction to reach the set position.

The first j-slot track 112 has a first pin position 114, a second pin position 115, a third pin position 116, a fourth pin position 117, a fifth pin position 118, and a sixth pin position 119. The movement of the pin 113 between the pin positions 114-119 actuates the first, or upper, packing element 110 between a running position and set position as detailed herein. From the sixth pin position 119 the pin 113 next moves into the first pin position 114 as pin 113 has traversed the first j-slot track 112 for 360 degrees around the first sleeve 111. Alternatively, the first sleeve 111 may be designed to have multiple first, second, third, fourth, fifth, and sixth pin positions 114-119 located around its perimeter as long as there is an equal number of each pin position as would be appreciated by one of ordinary skill in the art having the benefit of this disclosure.

The second j-slot track 122 has a first pin position 124, a second pin position 125, a third pin position 126, and a fourth pin position 127. The movement of the pin 123 between the pin positions 124-127 actuates the second, or lower, packing element 120 between a running position and set position as detailed herein. From the fourth pin position 127 the pin 123 next moves into the first pin position 124 as pin 123 has traversed the second j-slot track 122 for 360 degrees around the second sleeve 121. Alternatively, the second sleeve 121 may be designed to have multiple first, second, third, and fourth pin positions 124-127 located around its perimeter as long as there is an equal number of each pin position as would be appreciated by one of ordinary skill in the art having the benefit of this disclosure.

Figure 3:
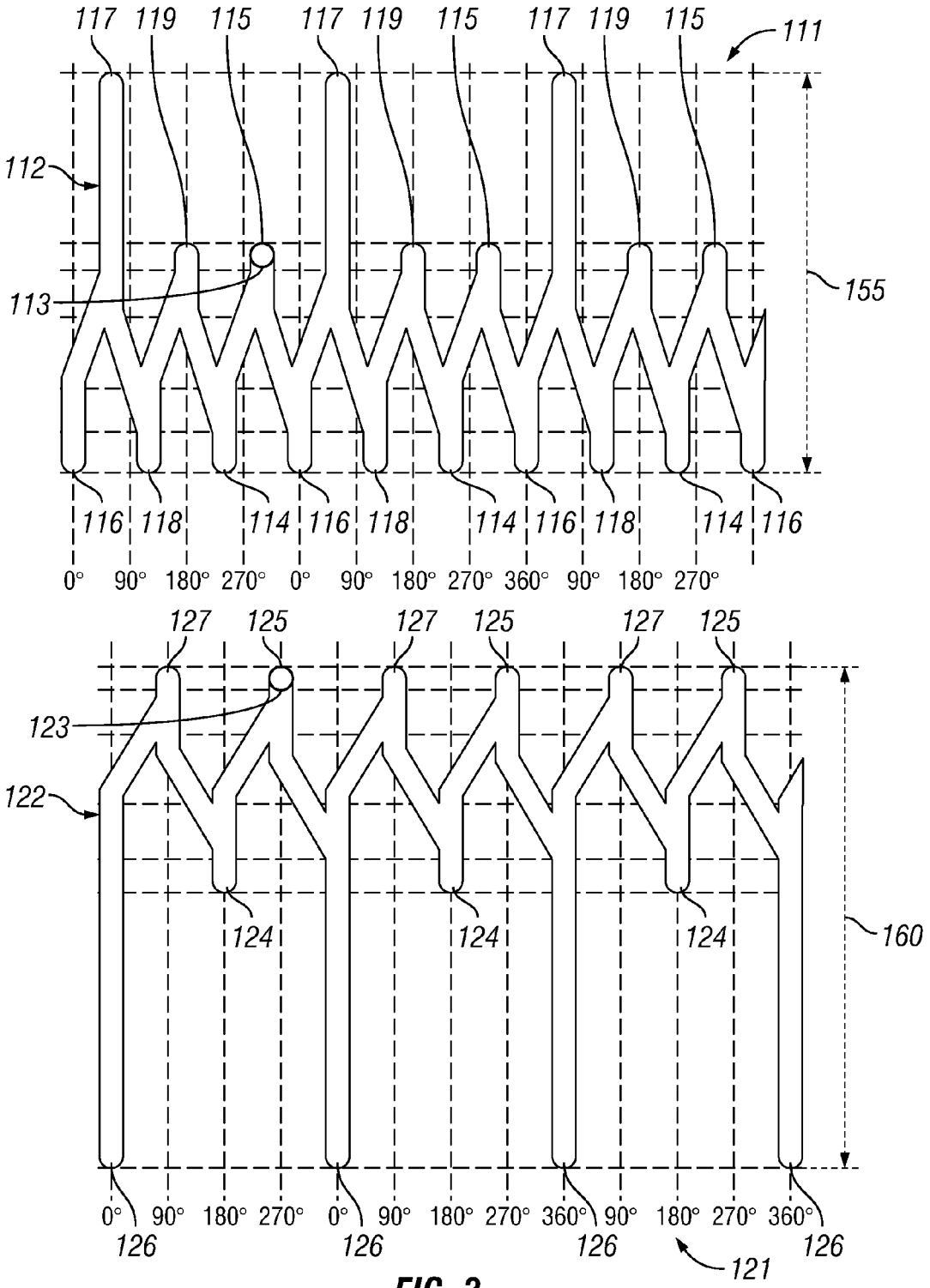
FIG. 3 shows a depiction of an upper sleeve having a continuous j-slot track and a depiction of a lower sleeve having a continuous j-slot track.
Figure 4:
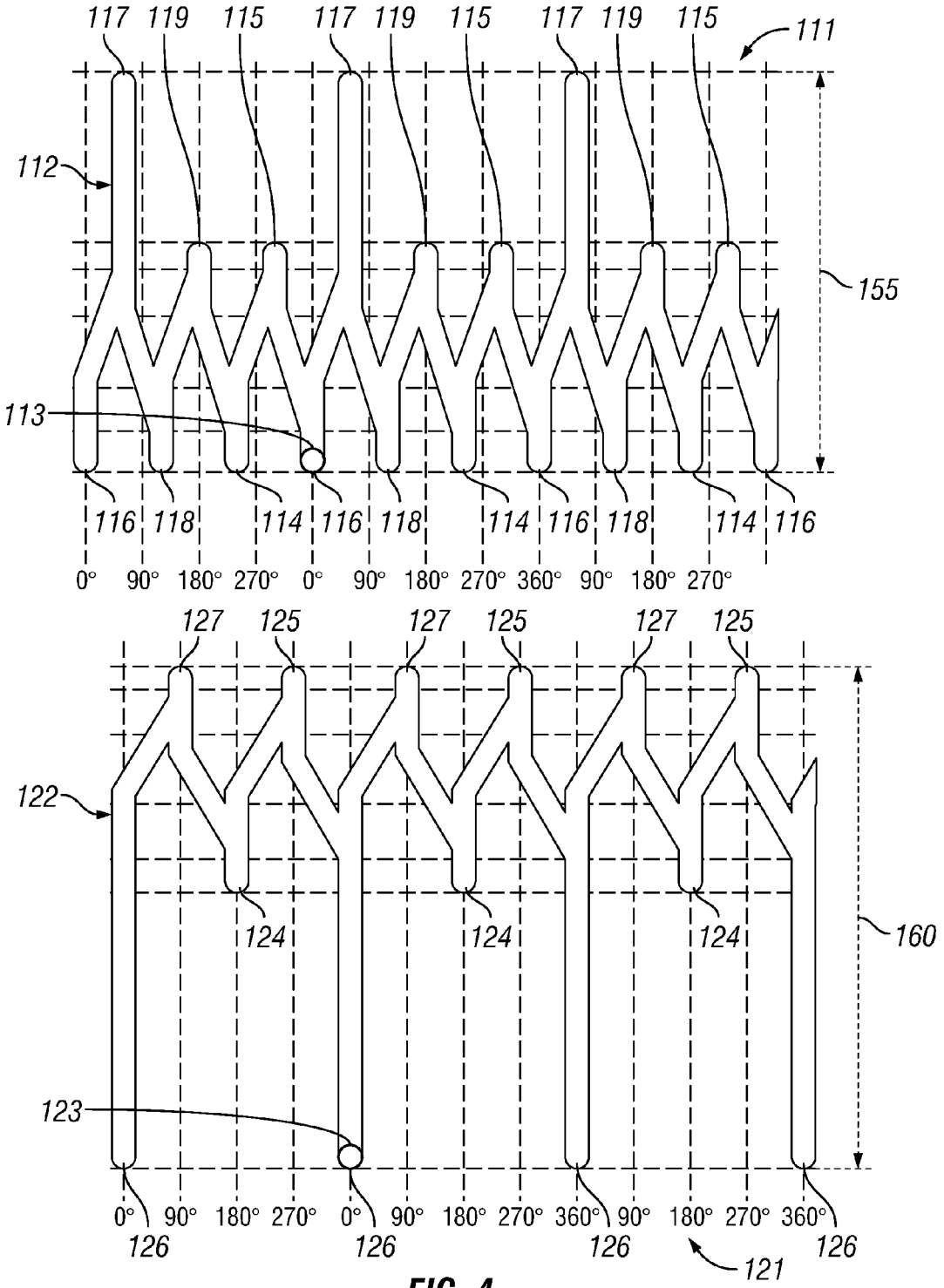
FIG. 4 shows a depiction of an upper sleeve having a continuous j-slot track and a depiction of a lower sleeve having a continuous j-slot track.

As discussed above, the tool 100 is inserted into the wellbore with the pins 113 and 123 in their respective first pin positions 114 and 124. Once the tool 100 is positioned at a desired location within the wellbore, the tool 100 is stopped and the work string 5 is picked up in the hole moving the pins 113 and 123 to their respective second pin positions 115 and 125 as shown in FIG. 3. The second or lower packer 120 is then set within the wellbore to create a lower seal between the tool 100 and the casing 1 by moving the pins 113 and 123 to their respective third pin positions 116 and 126 as shown in FIG. 4. The movement of the pins 113 and 123 to their respective third pin positions 116 and 126 is down by pushing down the work string 5, which sets the lower packing element 120 in compression.

Figure 5:
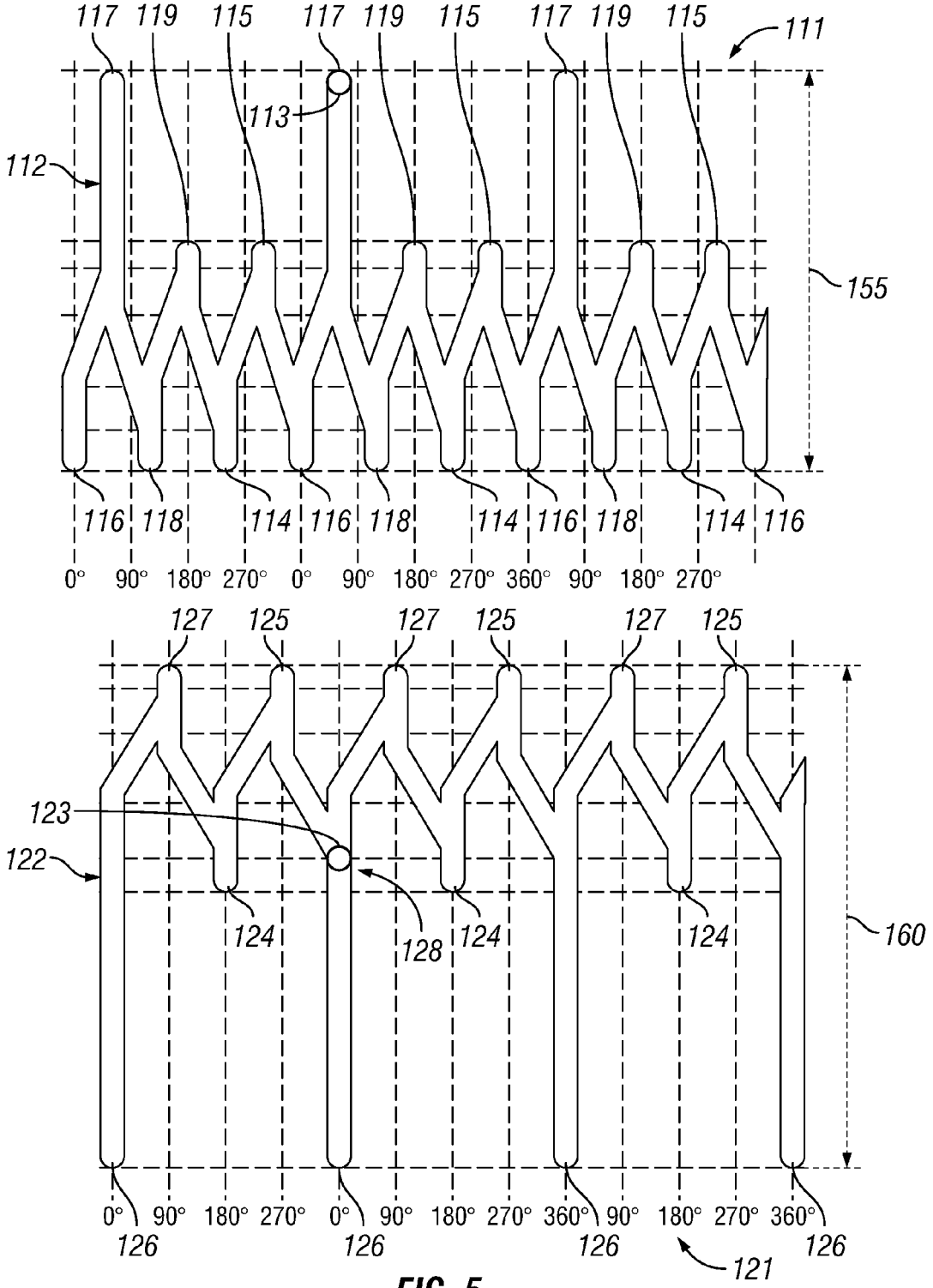
FIG. 5 shows a depiction of an upper sleeve having a continuous j-slot track and a depiction of a lower sleeve having a continuous j-slot track.

After the lower packing element 120 is set, the upper packing element 110 is set within the casing 1 of the wellbore by pulling up on the work string 5, which moves the first pin 113 to the fourth pin position 117 as shown in FIG. 5. The upper packing element 110 is set in tension due to the upward movement of the work string 5 while the lower portion of the tool 100 remains static due to the lower packing element 120 remaining set in the wellbore as discussed herein.

The upward movement of the work string 5 moves the second pin 123 to a location 128 along the second j-slot track 122, but does not unset the lower packing element 120 because the second pin 123 does not move, at this time, into the fourth pin position 127 on the second j-slot track 122. The third and fourth positions 126 and 127 on the second j-slot track 122 are designed to be separated by a second distance 160 that is longer than a first distance 155 that separates the third and fourth positions 116 and 117 of the first j-slot track 112. Thus, the second pin 123 does not move into the fourth pin position 127 along the second j-slot track 122 and the lower packing element 120 remains set while the upper packing element 110 is being set. At this point, both packing elements 110 and 120 are set within the wellbore and the portion of the wellbore between the packing elements 110 and 120 is hydraulically isolated from the rest of the wellbore. Once hydraulically isolated, a downhole job may be executed. For example, that portion of the wellbore may be treated by pumping fluid down the work string 5 and out a ported sub 130 positioned between the packing elements 110 and 120. As discussed above, the first distance separating the third and fourth pin positions 116 and 117 is less than the second distance separating the third and fourth pin positions 126 and 127. In one embodiment, the first distance may be approximately two thirds the second distance.

Figure 6:
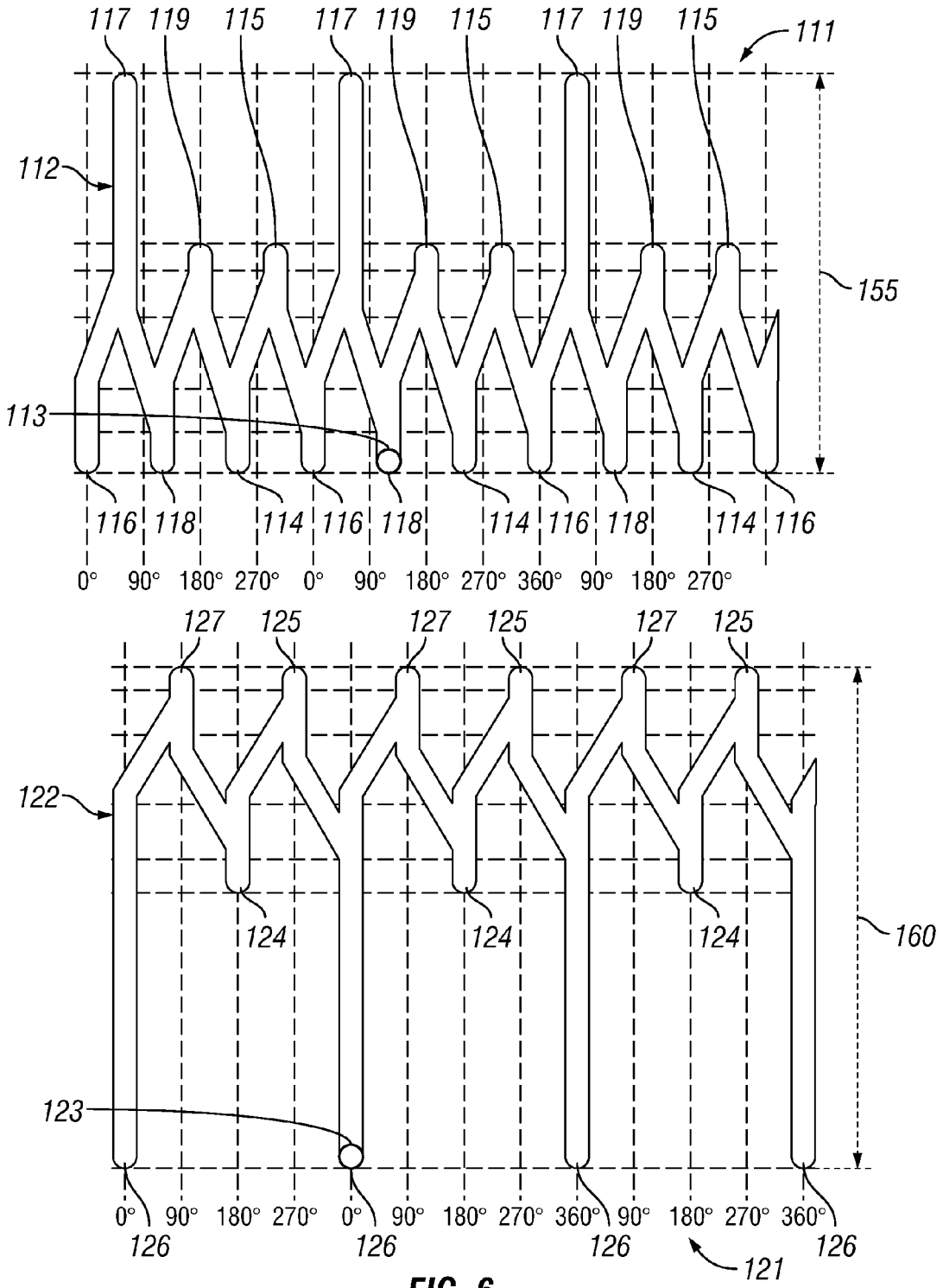
FIG. 6 shows a depiction of an upper sleeve having a continuous j-slot track and a depiction of a lower sleeve having a continuous j-slot track.

After a job has been completed while the packing elements 110 and 120 create seals with the casing 1 of the wellbore, the work string 5 may be moved downwards moving the first pin 113 to the fifth pin position 118 along the first j-track slot 112 of the first sleeve 111, as shown in FIG. 6. The first, or upper, packing element 110 is released, i.e. moved to an unset position, with the movement of the first pin 113 to the fifth pin position 118. The downward movement of the work string 5 moves the second pin 123 back to the third pin position 126 along the second j-slot track 122 of the second sleeve 121 as shown in FIG. 6. Thus, the second, or lower, packing element 120 remains set against the casing 1.

Figure 7:
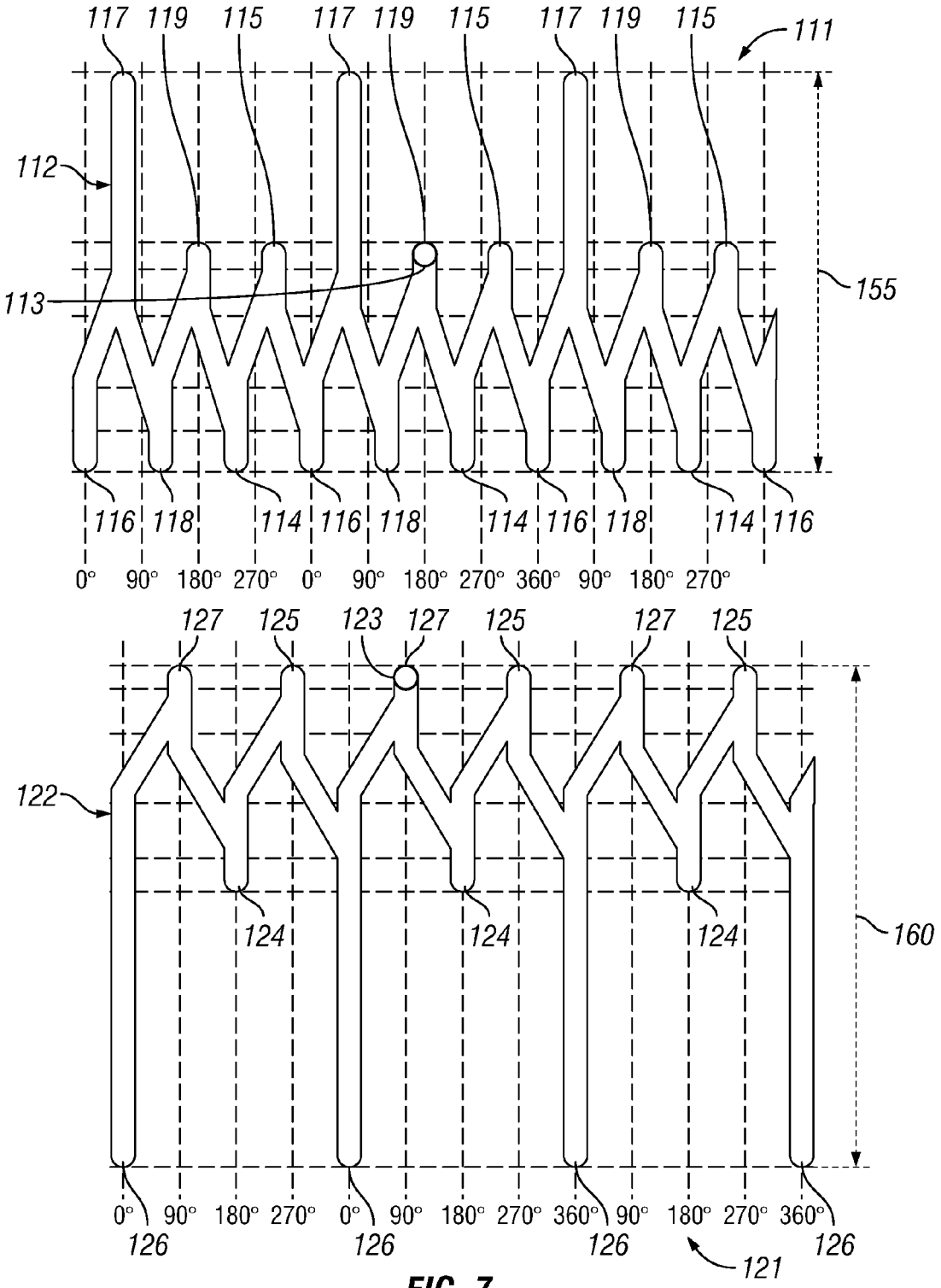
FIG. 7 shows a depiction of an upper sleeve having a continuous j-slot track and a depiction of a lower sleeve having a continuous j-slot track.

After the first, or upper, packing element 110 has been released the work string 5 is picked up in the hole moving the first pin 113 to the sixth pin position 119 along the first j-track slot 112 of the first sleeve 111 and moving the second pin 123 to the fourth pin position 127 along the second j-track slot 122 of the second sleeve 121, as shown in FIG. 7. The movement of the second pin 123 to the fourth pin position 127 along the second j-track slot 122 unset the second, or lower, packing element 120 of the downhole tool 100.

Figure 8:
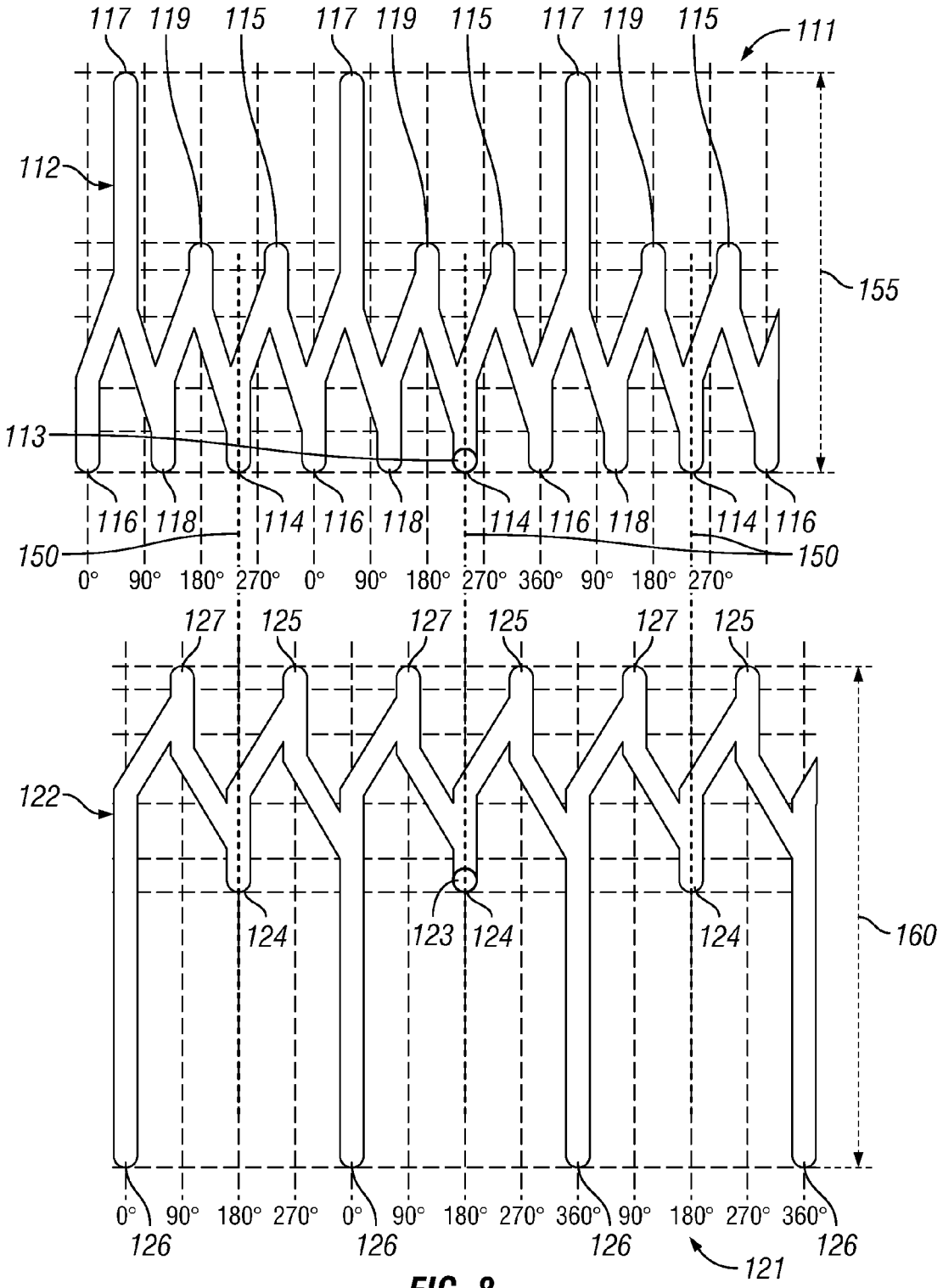
FIG. 8 shows a depiction of an upper sleeve having a continuous j-slot track and a depiction of a lower sleeve having a continuous j-slot track.

The work string 5 may then be pushed down to move the first pin 113 to the first pin position 114 along the first j-track slot 112 of the first sleeve 111 and move the second pin 123 to the first pin position 124 along the second j-track slot 122 of the second sleeve 121 as shown in FIG. 8. The first pin position 114 along the first j-slot track 112 is axially aligned with the first pin position 124 along the second j-slot track 122 as shown by line 150 in FIG. 8. The tool 100 may now be moved to another desired location in the wellbore. As discussed above, the sleeves 111 and 121 may have been rotated 360 degrees so that the pins 113 and 123 are now back in the first pin positions 114 and 124. Alternatively, the sleeves 111 and 121 may include more than one set of pin positions 114-119 and 124-127 along the length of the sleeves 111 and 121.

As discussed above, the first j-slot track 111 includes six (6) different pin positions 114-119 and the second j-slot track 121 includes four (4) different pin positions 124-127. Thus, each of the pin positions 114-119 of the first j-slot track 111 do not align with the pin positions 124-127 of the second j-slot track 121. The first pin positions 114 and 124 of each j-slot track 111 and 121 need to be aligned so that the tool 100 may be run into the wellbore or moved to a different location along the wellbore with the packing elements 110 and 120 retain in a running, or unset, position. The pin positions 114-119 along the first j-slot track 111 may be positioned approximately sixty (60) degrees apart from each other and the pin positions 124-127 along the second j-slot track 121 may be positioned approximately ninety (90) degrees apart from each other. Other spacing between the pin positions 114-119 and 124-127 may be used if more than one set of pin positions 114-119 and 124-127 is used around the perimeter of the sleeves 111 and 121 as would be appreciated by one of ordinary skill in the art having the benefit of this disclosure.

Figure 9:
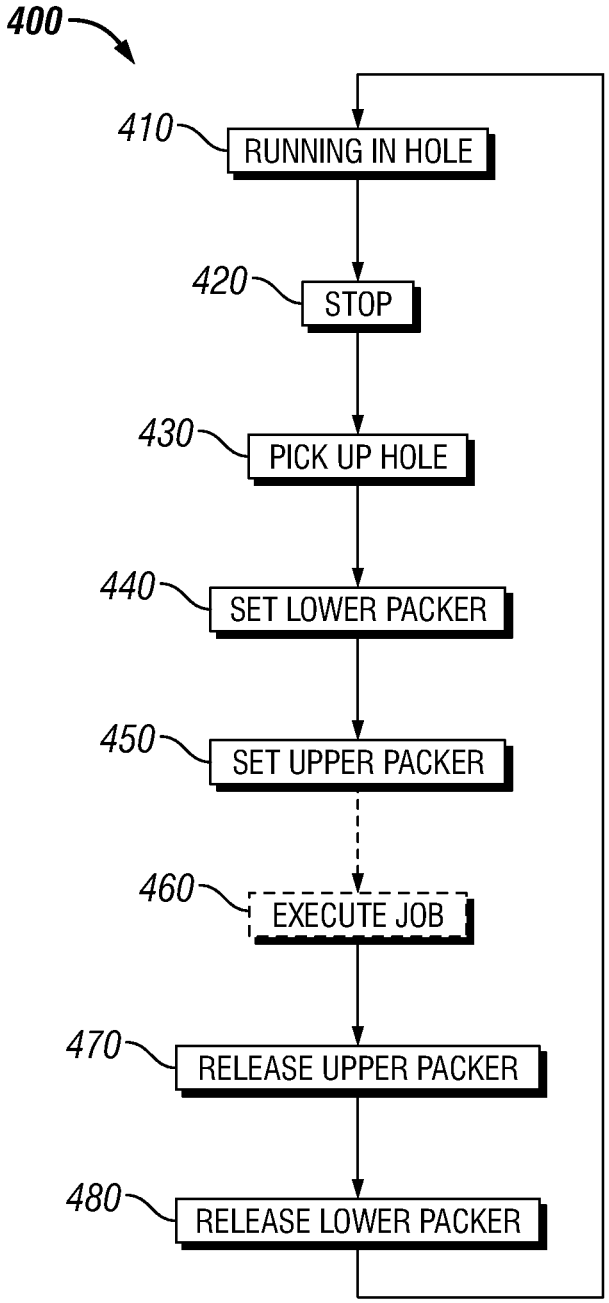
FIG. 9 shows an embodiment of a method of isolating a portion of a wellbore.

FIG. 9 shows an embodiment of a method 400 of isolating a portion of a wellbore. The method 400 includes the step 410 of running a downhole tool into the wellbore and the step 420 of stopping the tool at a desired location in the wellbore. The method 400 includes the step 430 picking up the work string within the wellbore. As discussed herein, picking up or setting down the work string moves pins along j-slot tracks to actuate or disengage packing elements of the downhole tool. The method 400 includes the step 440 of setting the lower packer within the wellbore and the step 450 of setting the upper packer within the wellbore. The method 400 optionally includes the step 460 of executing a job with the downhole tool. The job may be the treatment of a portion of the wellbore hydraulically isolated by the set upper and lower packers. The method 400 includes the step 470 of releasing the upper packer and the step 480 of releasing the lower packer. The tool may then be moved within the wellbore and the method 400 may be repeated.

Figure 10:
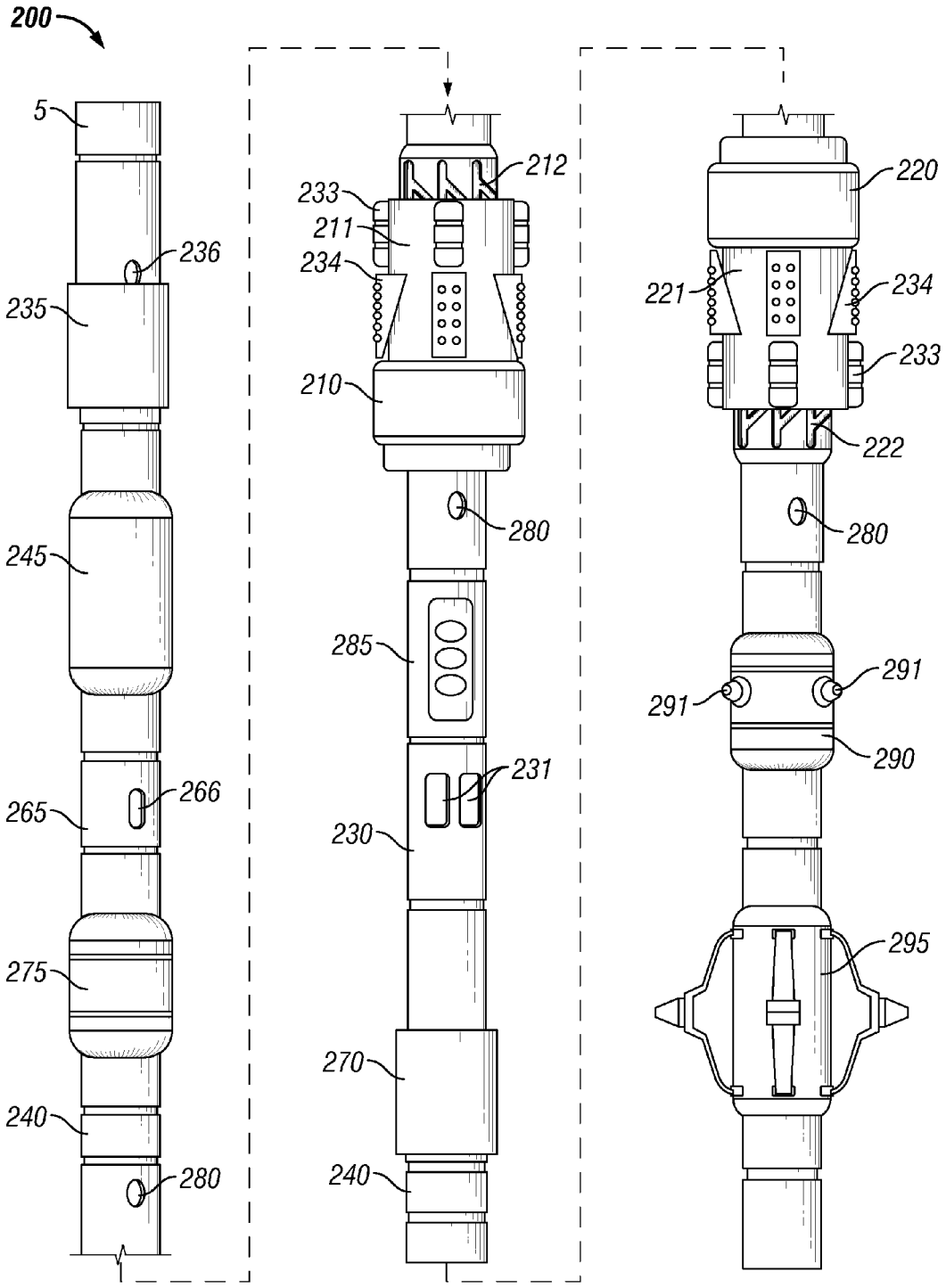
FIG. 10 shows an embodiment of a downhole tool having two packing elements within a wellbore.

FIG. 10 shows an embodiment of a downhole tool 200 having a first packing element 210 and a second packing element 220. The first packing element 210 may be an upper packer and the second packing element 220 may be a lower packer. The first and second packing elements 210 and 220 may each comprise a plurality of packing elements configured to create a seal between the tool 200 and casing or tubing of a wellbore. The downhole tool 200 is conveyed into the wellbore via a work string 5 and positioned at a desired location within the wellbore. The packing elements 210 and 220 may be actuated as described herein to selectively hydraulically isolate a portion of the wellbore that may be stimulated, treated, and/or fractured by fluid flowing out of ports 231 of a ported sub 230 located between the two packing elements 210 and 220.

The tool 200 may include various circulation subs 235 and 265 positioned at various locations along the length of the tool 200 that may circulate fluid out of ports 236 and 266. The circulate subs 235 and 265 may be mechanically actuated and/or electrically actuated to permit circulate of fluid out of the ports 236 and 266. The tool 200 may include various sensors 280 positioned along the length of the tool 200 that may be used to measure downhole conditions such as pressure and/or temperature. The tool 200 may also include a fluid identification module 285 that may be used to measure various characteristics of the downhole fluid that may be beneficial in analyzing the wellbore. Such characteristics of the fluid may include, but are not limited to, resistivity, capacitance, flow, magnetic resonance, density, or saturation. The sensors 280 or fluid identification module 285 may include optical and/or acoustic sensors. The information from the sensors 280 and/or fluid identification module 285 may be stored within a telemetry and memory sub 245. The data stored within the memory sub 245 may be analyzed when the tool 200 is returned to the surface.

The tool 200 may include an electrical casing collar locator (CCL) 275 positioned along the length of the tool 200 to aid in determining the location of the tool 200 while within a wellbore. Likewise, the tool 200 may include a mechanical CCL 295 positioned along the length of the tool 200 to aid in determining the location of the tool 200 while within a wellbore. The tool 200 may include a single CCL both a mechanical CCL 295 and an electrical CCL 275. The tool 200 may include various quick disconnect subs 240 positioned along the length of the tool 200 to aid in removal of at least a portion of the tool 200 in the event the tool 200 becomes stuck within a wellbore. The tool 200 may include a sand jet perforating sub 290 having ports 291. The sand jet perforating sub 290 may be used to perforate casing and/or tubing within a wellbore.

As discussed herein, the packing elements 210 and 220 of the downhole tool 200 are actuated by movement along two j-track slots 212 and 222. A portion of an upper j-track slot 212 is shown in FIG. 10 extending beyond an upper rotating sub 211 of the tool 200. Likewise, a portion of a lower j-track slot is shown in FIG. 10 extending beyond a lower rotating sub 221 of the tool. The rotating subs 211 and 221 rotate to move through the various positions along the j-track slots 212 and 222 to actuate and unset the packing elements 210 and 220 as described herein. The rotating subs 211 and 221 may also be referred to as rotating sleeves as would be appreciated by one of ordinary skill in the art having the benefit of this disclosure.

The tool 200 may include a slip joint 270 positioned between the upper and lower packing elements 210 and 220. The slip joint 270 permits the lengthening of the distance between the lower packing element 220 and the upper packing element 210 while the upper packing element 210 is being set within the wellbore. As detailed herein, the lower packing element 220 is set within the wellbore before the upper packing element 210 is set. The lengthening of the distance between the packing elements 210 and 220 may aid in preventing the lower packing element 220 from becoming unset during the setting of the upper packing element 210. The rotating subs 211 and 221 may include slips 234 and drag blocks 233 that aid in the setting of the packing elements 210 and 220 within the wellbore.

Figures 11A, 11B, 11C, 11D:
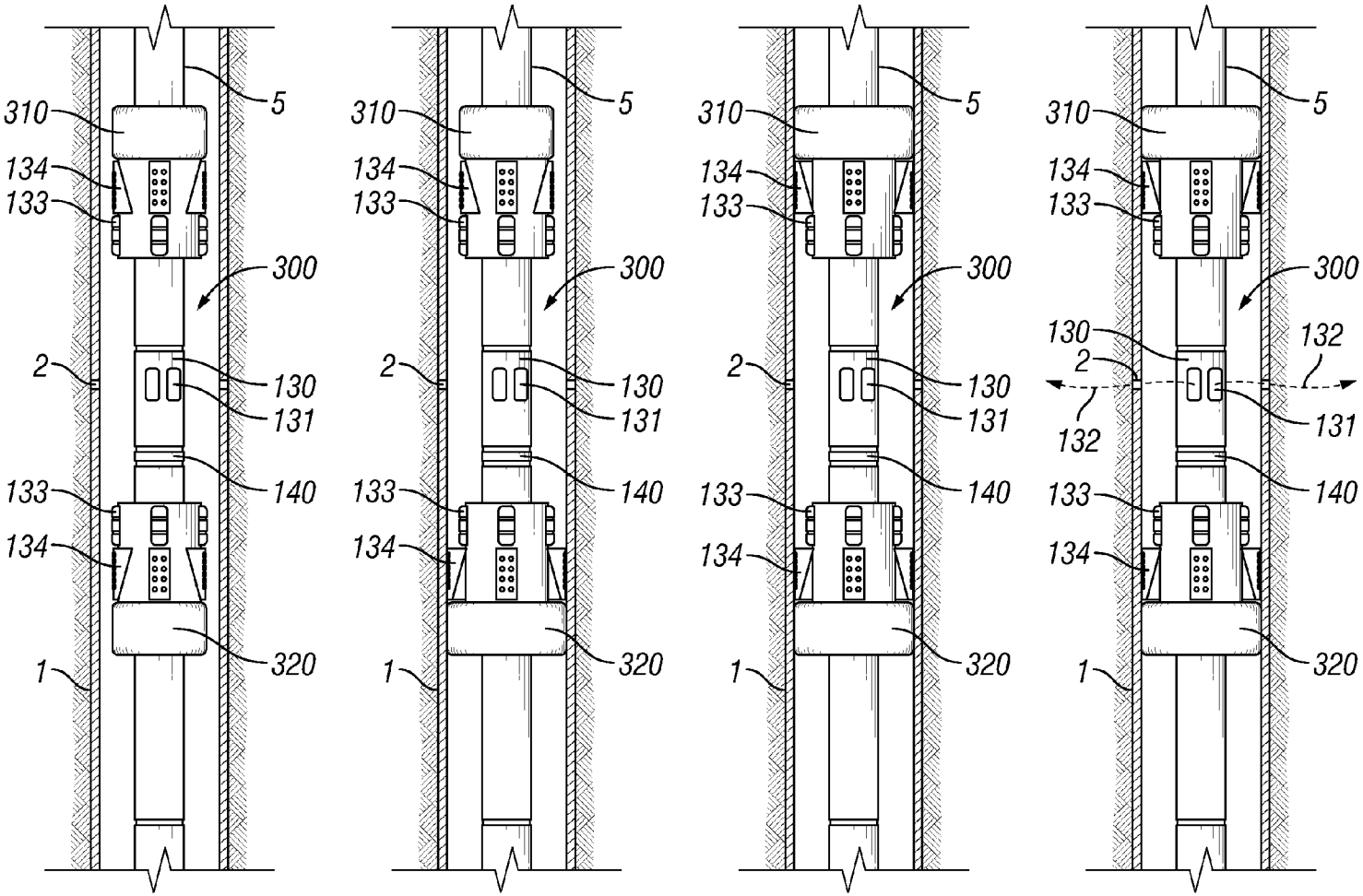
FIG. 11A shows an embodiment of a downhole tool having two packing elements within a wellbore.
FIG. 11B shows an embodiment of a downhole tool with the lower packing element set within a wellbore.
FIG. 11C shows an embodiment of a downhole tool with the upper and lower packing elements set within a wellbore.
FIG. 11D shows the treatment of a portion of a wellbore that has been hydraulically isolated by an embodiment of a downhole tool.

FIG. 11A shows an embodiment of a downhole tool 300 having a first packing element 310 and a second packing element 320. The first packing element 310 may be an upper packer and the second packing element 320 may be a lower packer. The first and second packing elements 310 and 320 may each comprise a plurality of packing elements configured to create a seal between the tool 300 and casing 1, or tubing, of a wellbore. The downhole tool 300 is conveyed into the wellbore via a work string 5 and positioned at a desired location within the wellbore. For example, the downhole tool 300 may be positioned adjacent a perforation (s) 2 in the casing 1. The wellbore may then be treated via the tool 300 as discussed herein. The work string 5 may be various strings as would be appreciated by one of ordinary skill in the art having the benefit of this disclosure. FIG. 1A shows the packing elements 310 and 320 in a running position, i.e. a retracted or unset orientation, so that the tool 300 may be moved through the casing or tubing 1 of the wellbore. The tool 300 includes a ported sub 130 having one or more flow ports 131 and a quick disconnect sub 140 that are described herein.

FIG. 11B shows the second, or lower, packing element 320 set against the casing 1 of the wellbore to create a seal between the tool 300 and the casing 1. The second packing element 320 may be set in tension by the rotation of a sleeve or rotating sub connected to the second packing element 320. FIG. 11C shows the first, or upper, packing element 310 set against the casing 1 of the wellbore to create a seal between the tool 300 and the casing 1. The first packing element 310 may be set in compression by the rotation of a sleeve or rotating sub connected to the first packing element 310. The rotating subs and j-tracks may be configured as to set the lower packing element 320 in tension and the upper packing element 310 in compression as would be appreciated by one ordinary skill in the art having the benefit of this disclosure.

The setting of the first and second packing elements 310 and 320 hydraulically isolates the portion of the wellbore between the packing elements 310 and 320 from the rest of the wellbore. FIG. 11D shows the treatment of the wellbore by flowing fluid out of the flow ports 131 of the ported sub 130 as shown by arrows 132. The formation of the wellbore may be treated via perforations 2 through the casing 1. Fluid is pumped down the work string 5 and out the ports 131 of the ported sub 130. After the portion of the wellbore has been treated, the packing elements 310 and 320 may be unset, i.e. moved to their running position, and the tool 300 may be moved to another location within the wellbore. Treating the wellbore formation may comprise various applications such as stimulating or fracturing the formation as would be appreciated by one of ordinary skill in the art having the benefit of this disclosure. The quick disconnect sub 140 permits the upper portion of the tool 100 to be disconnected from the second packing element 320 to the extent the tool 300 becomes stuck within the wellbore. The upper portion of the tool 300 and the work string 5 may then be removed from the wellbore. The lower portion of the tool 300 may then be fished out of the wellbore. Alternatively, the lower portion of the tool 300 may be drilled out or simply pushed to the bottom of the wellbore Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A dual packer comprising:

a first packing element;

a first sleeve having a first continuous j-slot track that extends completely around a perimeter of the first sleeve, wherein movement of a first pin along the first j-slot track actuates the first packing element between a set position and a running position;

a second packing element; and a second sleeve having a second continuous j-slot track that extends completely around a perimeter of the second sleeve, wherein movement of a second pin along the second j-slot track actuates the second packing element between a set position and a running position, wherein the second j-slot track is inverted with respect to the first j-slot track.

2. The dual packer of claim 1, further comprising a slip joint positioned between the first packing element and the second packing element, wherein the slip joint is adapted to change a length between the first and second packing elements.

3. The dual packer of claim 2, wherein the first packing element may be first set against a portion of a wellbore and wherein the second packing element may then be set against a portion of the wellbore while connected to the first packing element via the slip joint.

4. The dual packer of claim 1, further comprising a casing collar locator.

5. The dual packer of claim 1, wherein the first packing element is an upper packer that is set in tension and the second packing element is a lower packer that is set in compression.

6. The dual packer of claim 1, wherein the first packing element is an upper packer that is set in compression and the second packing element is a lower packer that is set in tension.

7. The dual packer of claim 1, the first j-slot track having six pin positions along a circumferential length of the first j-slot track and the second j-slot track having four pin positions along a circumferential length of the second j-slot track.

8. The dual packer of claim 7, the six pin positions of the first j-slot track being approximately sixty degrees apart and the four pin positions of the second j-slot track being approximately ninety degrees apart.

9. The dual packer of claim 7, wherein movement of the second pin from a second pin position to a third pin position along the second j-slot track sets the second packing element and wherein movement of the first pin from a third pin position to a fourth pin position along the first j-slot track sets the first packing element.

10. The dual packer of claim 9, wherein a second distance between the third pin position and a fourth pin position of the second j-slot track is greater than a first distance between the third pin position and the fourth pin position of the first j-slot track.

11. The dual packer of claim 10, wherein the first distance is approximately two thirds the second distance.

12. The dual packer of claim 1, the first j-slot track comprising more than one set of six pin positions along a circumferential length of the first j-slot track and the second j-slot track comprising more than one set of four pin positions along a circumferential length of the second j-slot track.

13. A method of treating a wellbore formation using the dual packer of claim 1.

14. The method of claim 13, wherein treating further comprises stimulating the wellbore formation.

15. The method of claim 13, wherein treating further comprises fracturing the wellbore formation.

16. A system to isolate and treat a portion of a wellbore comprising:

an upper packer;

a first sleeve having a continuous j-slot track that extends completely around a perimeter of the first sleeve, wherein movement of a first pin along the j-slot track of the first sleeve actuates the upper packer between a set position and a running position;

a lower packer;

a second sleeve having a continuous j-slot track that extends completely around a perimeter of the second sleeve, wherein movement of a second pin along the j-slot track of the second sleeve actuates the lower packer between a set position and a running position, the j-slot track of the second sleeve being inverted with respect to the j-slot track of the first sleeve; and a ported sub being connected between the upper packer and the lower packer.

17. The system of claim 16, further comprising a work string connected to the upper packer, wherein fluid may be pumped down the work string and out the ported sub.

18. The system of claim 16, the j-slot track of the first sleeve having six pin positions along the first sleeve and the j-slot track of the second sleeve having four pin positions along the second sleeve.

19. The system of claim 16, wherein the lower packer may be first set against a portion of a wellbore and wherein the upper packer may then be set against a portion of the wellbore while being connected to the lower packer via the ported sub.

20. A method of isolating a portion of a wellbore comprising:

running a tool on a work string into a wellbore;

positioning the tool adjacent a portion of the wellbore;

picking up the work string to move a first pin along a continuous j-slot track of a first sleeve that extends completely around a perimeter of the first sleeve and to move a second pin along a continuous j-slot track of a second sleeve that extends completely around a perimeter of the second sleeve;

setting a lower packer of the tool;

setting an upper packer of the tool after setting the lower packer;

releasing the upper packer of the tool; and releasing the lower packer of the tool after releasing the upper packer.

21. The method of claim 20, wherein picking up the work string moves the first pin from a first pin position on the continuous j-slot track of the first sleeve to a second pin position and moves the second pin from a second pin position on the continuous j-slot track of the second sleeve to a second pin position.

22. The method of claim 21, wherein setting the lower packer further comprises moving the first pin from the second pin position on the j-slot track of the first sleeve to a third position and moving the second pin from the second pin position on the j-slot track of the second sleeve to a third position.

23. The method of claim 22, wherein setting the upper packer further comprises moving the first pin from the third pin position on the j-slot track of the first sleeve to a fourth pin position while the lower packer remains set.

24. The method of claim 23, wherein releasing the upper packer further comprises moving the first pin from the fourth pin position on the j-slot track of the first sleeve to a fifth pin position while the lower packer remains set.

25. The method of claim 24, wherein releasing the lower packer further comprises moving the first pin from the fifth pin position on the j-slot track of the first sleeve to a sixth pin position and moving the second pin from the third pin position on the j-slot track of the second sleeve to a fourth pin position.

26. The method of claim 20, further comprising pumping fluid down the work string and out a ported sub of the tool after setting the upper packer of the tool.

27. The method of claim 20, wherein the upper packer is set in tension and the lower packer is set in compression.

28. The method of claim 20, further comprising increasing a length between the upper packer and the lower packer while setting the upper packer of the tool.

29. The method of claim 28, wherein the set lower packer and set upper packer are both connected to the tool.

* * * * *